US012497851B2

(12) United States Patent
Hradecky et al.

(10) Patent No.: US 12,497,851 B2
(45) Date of Patent: Dec. 16, 2025

(54) IMPACT JAR DELAY, ACTIVATION INDICATOR, SHOCK ABSORBER, AND RELATCH ASSIST

(71) Applicant: Weatherford Technology Holdings, LLC, Houston, TX (US)

(72) Inventors: Jason Allen Hradecky, Heath, TX (US); James Patrick Massey, Leadville, CO (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 18/894,893

(22) Filed: Sep. 24, 2024

(65) Prior Publication Data

US 2025/0263996 A1 Aug. 21, 2025

Related U.S. Application Data

(60) Provisional application No. 63/555,394, filed on Feb. 19, 2024.

(51) Int. Cl.
*E21B 31/113* (2006.01)

(52) U.S. Cl.
CPC ..... *E21B 31/1135* (2013.01)

(58) Field of Classification Search
CPC ... E21B 31/107; E21B 31/113; E21B 31/1135
See application file for complete search history.

(56) References Cited

U.S. PATENT DOCUMENTS

| | | | | |
|---|---|---|---|---|
| 10,151,165 | B2 * | 12/2018 | Evans | E21B 31/113 |
| 2002/0112866 | A1 * | 8/2002 | Buyers | E21B 31/113 173/91 |
| 2003/0070842 | A1 * | 4/2003 | Bailey | E21B 31/113 175/325.1 |
| 2005/0092495 | A1 * | 5/2005 | Evans | E21B 31/107 166/301 |
| 2016/0145959 | A1 * | 5/2016 | Hradecky | E21B 17/042 166/301 |
| 2018/0156003 | A1 * | 6/2018 | Hradecky | E21B 31/107 |
| 2019/0368296 | A1 * | 12/2019 | Massey | E21B 31/1075 |

* cited by examiner

*Primary Examiner* — Matthew R Buck
(74) *Attorney, Agent, or Firm* — Boisbrun Hofman, PLLC

(57) ABSTRACT

An impact jar apparatus including a dynamic portion connectable to an upper tool string portion, a static portion connectable to a lower tool string portion, and a hydraulic manifold, an activation indicator, a relatch assist, and/or a shock absorber. The hydraulic manifold fluidly communicates with an annulus between the dynamic and static portions. The hydraulic manifold adjusts a delay between application of a trigger tension and consequent activation of the impact jar apparatus. The activation indicator, including a wire coil in the static portion and magnets carried by the dynamic portion, generates a magnetic field whereby a voltage pulse is generated in the wire coil in response to the magnetic field passing the wire coil upon activation of the impact jar apparatus. The relatch assist urges the dynamic and static portions toward a latched position. The shock absorber absorbs axial shock generated by activation of the impact jar apparatus.

20 Claims, 8 Drawing Sheets

IMPACT JAR DELAY, ACTIVATION INDICATOR, SHOCK ABSORBER, AND RELATCH ASSIST

CROSS-REFERENCE TO RELATED APPLICATIONS

This application claims priority to and the benefit of U.S. Provisional Application No. 63/555,394, titled "Impact Jar Delay, Surface Indicator, Shock Absorber, and Relatch Assist," filed Feb. 19, 2024, the entire disclosure of which is hereby incorporated herein by reference.

BACKGROUND OF THE DISCLOSURE

Drilling operations have become increasingly expensive as the need to drill deeper, in harsher environments, and through more difficult materials have become reality. Additionally, testing and evaluation of completed and partially finished wellbores has become commonplace, such as to increase well production and return on investment.

In working with deeper and more complex wellbores, it becomes more likely that tools, tool strings, and/or other downhole apparatus may become stuck within the wellbore. In addition to the potential to damage equipment in trying to retrieve it, the construction and/or operation of the well must generally stop while tools are fished from the wellbore. The fishing operations themselves may also damage the wellbore and/or the downhole apparatus.

One such downhole tool, referred to as a jar, may be used to dislodge a downhole apparatus when it becomes stuck within a wellbore. The jar is positioned in the tool string and/or otherwise deployed downhole to free the downhole apparatus. Tension load is applied to the tool string to trigger the jar, thus delivering an impact intended to dislodge the stuck portion of the tool string.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure introduces an impact jar apparatus including a dynamic portion, a static portion, and a hydraulic manifold. The dynamic portion has a first connector for connection to an upper portion of a downhole tool string for conveyance within a wellbore penetrating a subterranean formation. The static portion has a second connector for connection to a lower portion of the tool string. The hydraulic manifold is in fluid communication with an annulus defined between the dynamic and static portions. The hydraulic manifold is configurable to adjust a delay between application of a trigger tension to the tool string and consequent activation of the impact jar apparatus.

The present disclosure also introduces an impact jar apparatus including a dynamic portion, a static portion, and an activation indicator. The dynamic portion has a first connector for connection to an upper portion of a downhole tool string for conveyance within a wellbore penetrating a subterranean formation. The static portion has a second connector for connection to a lower portion of the tool string. The activation indicator provides real-time surface confirmation that the impact jar apparatus has activated. The activation indicator includes a wire coil and magnets. The wire coil is disposed within an external recess of the static portion. The magnets are carried by the dynamic portion and generate a magnetic field such that a voltage pulse is generated in the wire coil in response to the magnetic field passing by the wire coil upon activation of the impact jar apparatus.

The present disclosure also introduces an impact jar apparatus including a dynamic portion, a static portion, and a relatch assist. The dynamic portion has a first connector for connection to an upper portion of a downhole tool string for conveyance within a wellbore penetrating a subterranean formation. The static portion has a second connector for connection to a lower portion of the tool string. The relatch assist urges the dynamic and static portions toward a latched position.

The present disclosure also introduces an impact jar apparatus including a dynamic portion, a static portion, and a shock absorber. The dynamic portion has a first connector for connection to an upper portion of a downhole tool string for conveyance within a wellbore penetrating a subterranean formation. The static portion has a second connector for connection to a lower portion of the tool string. The shock absorber absorbs axial shock generated by activation of the impact jar apparatus.

These and additional aspects of the present disclosure are set forth in the description that follows, and/or may be learned by a person having ordinary skill in the art by reading the material herein and/or practicing the principles described herein. At least some aspects of the present disclosure may be achieved via means recited in the attached claims.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
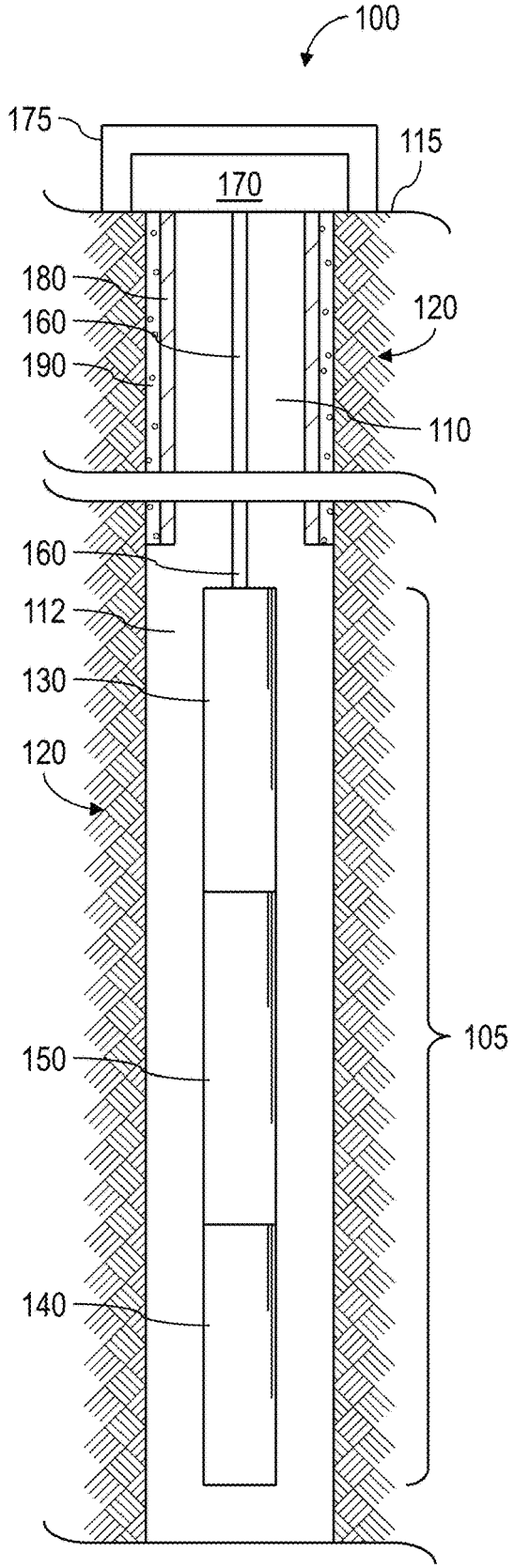
FIG. 1 is a schematic view of at least a portion of an example implementation of a wellsite system according to one or more aspects of the present disclosure.

It is also to be understood that the following disclosure may provide different examples for implementing different features of various implementations. Specific examples of components and arrangements are described below to simplify the present disclosure. These are, of course, merely examples and are not intended to be limiting. In addition, the following disclosure may repeat reference numerals and/or letters in more than one implementation. This repetition is for simplicity and clarity and does not in itself dictate a relationship between the various implementations and/or configurations discussed. Moreover, the formation of a first feature over or on a second feature in the description that follows may include implementations in which the first and second features are formed in direct contact and/or implementations in which additional features may be formed interposing the first and second features, such that the first and second features may not be in direct contact.

FIG. 1 is a sectional view of at least a portion of an example implementation of a wellsite system 100 according to one or more aspects of the present disclosure. The wellsite system 100 comprises a tool string 105 suspended within a wellbore 110 that extends from a wellsite surface 115 into one or more subterranean formations 120. The tool string 105 comprises a first portion 130, a second portion 140, and an impact jar apparatus 150 coupled between the first and second tool string portions 130, 140. The tool string 105 is suspended within the wellbore 110 via conveyance means 160 operably coupled with a tensioning device 170 and/or other surface equipment 175 disposed at the wellsite surface 115. The wellbore 110 is depicted in FIG. 1 as being a cased-hole implementation comprising a casing 180 secured by cement 190. However, one or more aspects of the present disclosure are also applicable to and/or readily adaptable for utilization in open-hole implementations lacking the casing 180 and cement 190.

The tensioning device 170 is operable to apply an adjustable tensile force to the tool string 105 via the conveyance means 160. Although depicted schematically in FIG. 1, a person having ordinary skill in the art will recognize the tensioning device 170 as being, comprising, or forming at least a portion of a crane, winch, drawworks, top drive, and/or other lifting device coupled to the tool string 105 by the conveyance means 160. The conveyance means 160 is or comprises wireline, slickline, e-line, coiled tubing, drill pipe, production tubing, and/or other conveyance means, and comprises and/or is operable in conjunction with means for communication between the tool string 105 and the tensioning device 170 and/or one or more other portions of the surface equipment 175. The first and second tool string portions 130, 140 may each be or comprise one or more downhole tools, modules, and/or other apparatus operable in wireline, while-drilling, coiled tubing, completion, production, and/or other implementations.

The impact jar apparatus 150 may be employed to dislodge and/or retrieve a portion of the tool string 105 that has become lodged or stuck within the wellbore 110, such as the second tool string portion 140. The impact jar apparatus 150 may be coupled to the second tool string portion 140 before the tool string 105 is conveyed into the wellbore 110, such as in prophylactic applications, or after at least a portion of the tool string 105 (e.g., the second tool string portion 140) has become lodged or stuck in the wellbore 110, such as in "fishing" applications.

Figure 2:
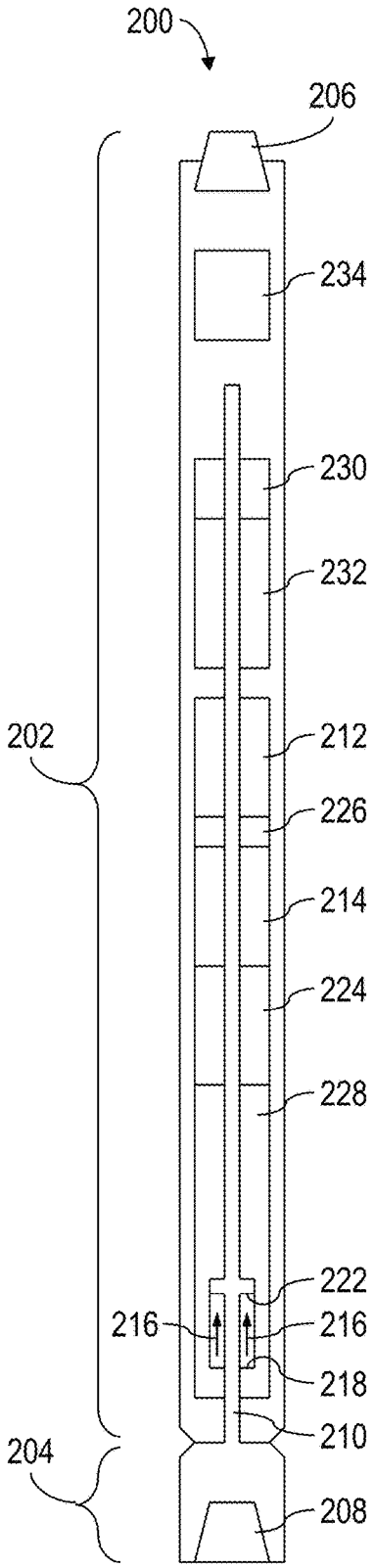
FIG. 2 is a schematic view of at least a portion of an example implementation of an impact jar apparatus of the wellsite system shown in FIG. 1 according to one or more aspects of the present disclosure.

FIG. 2 is a schematic diagram of at least a portion of an example implementation of an impact jar apparatus 200 according to one or more aspects introduced by the present disclosure. The impact jar apparatus 200 is an example implementation of the impact jar apparatus 150 shown in FIG. 1.

The impact jar apparatus 200 comprises an upper section 202 and a lower section 204. The upper section 202 comprises a mechanical and electrical connector 206 for connecting to an upper tool string portion, such as the first tool string portion 130 shown in FIG. 1. The lower section 204 comprises a mechanical and electrical connector 208 for connecting to a lower tool string portion, such as the second tool string portion 140 shown in FIG. 1.

A tubular feature 210 affixed to the lower section 204 extends upward through several components of the upper section 202. A latch 212 of the upper section 202 releasably retains the tubular feature 210 in a latched position. When the tool string 105 becomes lodged ("stuck") in the wellbore 110, activation of the impact jar apparatus 200 is initiated by controlling the tensioning device 170 to apply axial tension to the tool string 105 via the conveyance means 160 sufficient to compress a biasing means (e.g., a Belleville stack) 214 such that relative axial motion of the tubular feature 210 and the latch 212 disengages the latch 212 from the tubular feature 210. Consequently, as a result of the tension in the conveyance means 160, the upper section 202 rapidly moves upward (as depicted in FIG. 2 by arrows 216) until an impact surface 218 of the upper section 202 forcefully impacts a corresponding impact surface 222 of the tubular feature 210, thereby applying an upward jarring force to the lower section 204 and, thus, the lower tool string portion 140, in an attempt to dislodge the tool string 105 from the wellbore 110.

The impact jar apparatus 200 may also include an adjuster 224 by which the "trigger tension" at which the impact jar apparatus 200 is activated may be manually adjusted at the wellsite surface 115 before the tool string 105 is conveyed into the wellbore 110. For example, the adjuster 224 may be or comprise a rotatable component that adjusts the static compression (e.g., when no tension is applied by the tensioning device 170 or gravity) of the biasing means 214. The rotatable component can be manually rotated at the wellsite surface 115 without disassembly of the impact jar apparatus 200 or the tool string 105.

The impact jar apparatus 200 may also comprise a hydraulic piston 226 and a hydraulic manifold 228, such as described below with respect to FIGS. 5 and 9-11. The impact jar apparatus 200 may also comprise an activation indicator 230 and/or a relatch assist 232, such as described below with respect to FIG. 12. The impact jar apparatus 200 may also comprise a shock absorber 234, such as described below with respect to FIG. 13.

The above-described components of the impact jar apparatus 200 may be arranged other than as depicted in FIG. 2. Moreover, many of the components of the impact jar apparatus 200 can be classified as belonging to a static portion 250 of the apparatus 200, schematically depicted in FIG. 3, and a dynamic portion 251 of the apparatus 200, schematically depicted in FIG. 4. Referring to FIGS. 1-4, collectively, the static portion 250 generally comprises the tubular feature 210 that, during jarring operations, is indirectly coupled (e.g., by the lower connector 208) to the lower tool string portion 140 which has become stuck in the wellbore 110, thus being fixed in an axial position relative to the wellbore 110. In such jarring operations, the dynamic portion 251 of the impact jar apparatus 200 (e.g., the latch 212, the biasing means 214, the adjuster 224, and the hydraulic piston 226, among other components) is indirectly coupled via the upper connector 206 to the upper tool string portion 130 and, thus, moves axially with the upper tool string portion 130 and the conveyance means 160 relative to the tubular feature 210 and the wellbore 110, in response to tension applied by the conveyance means 160 via operation of the tensioning device 170.

Figure 3:
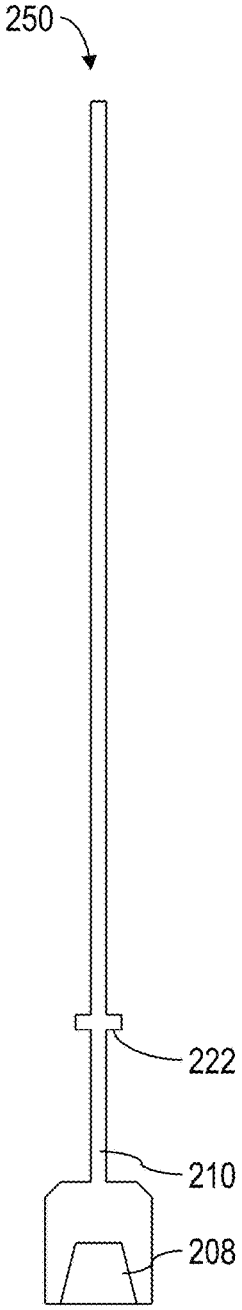
FIG. 3 is a schematic view of a static portion of the impact jar apparatus shown in FIG. 2 according to one or more aspects of the present disclosure.
Figure 4:
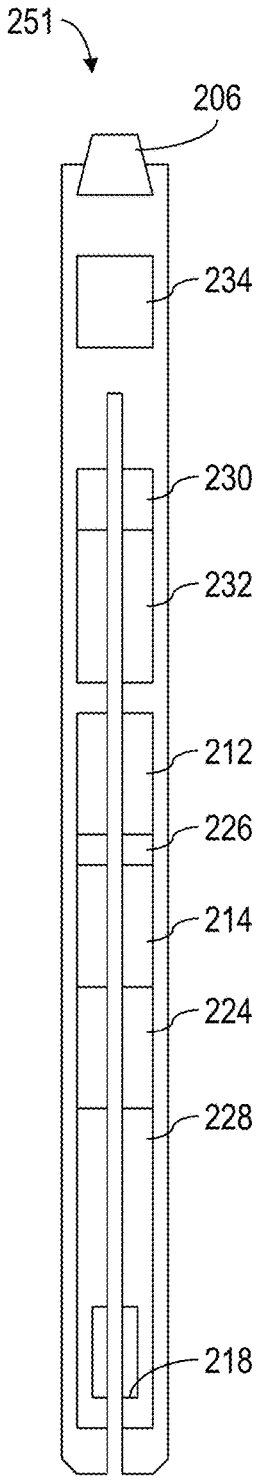
FIG. 4 is a schematic view of a dynamic portion of the impact jar apparatus shown in FIG. 2 according to one or more aspects of the present disclosure.
Figure 5:
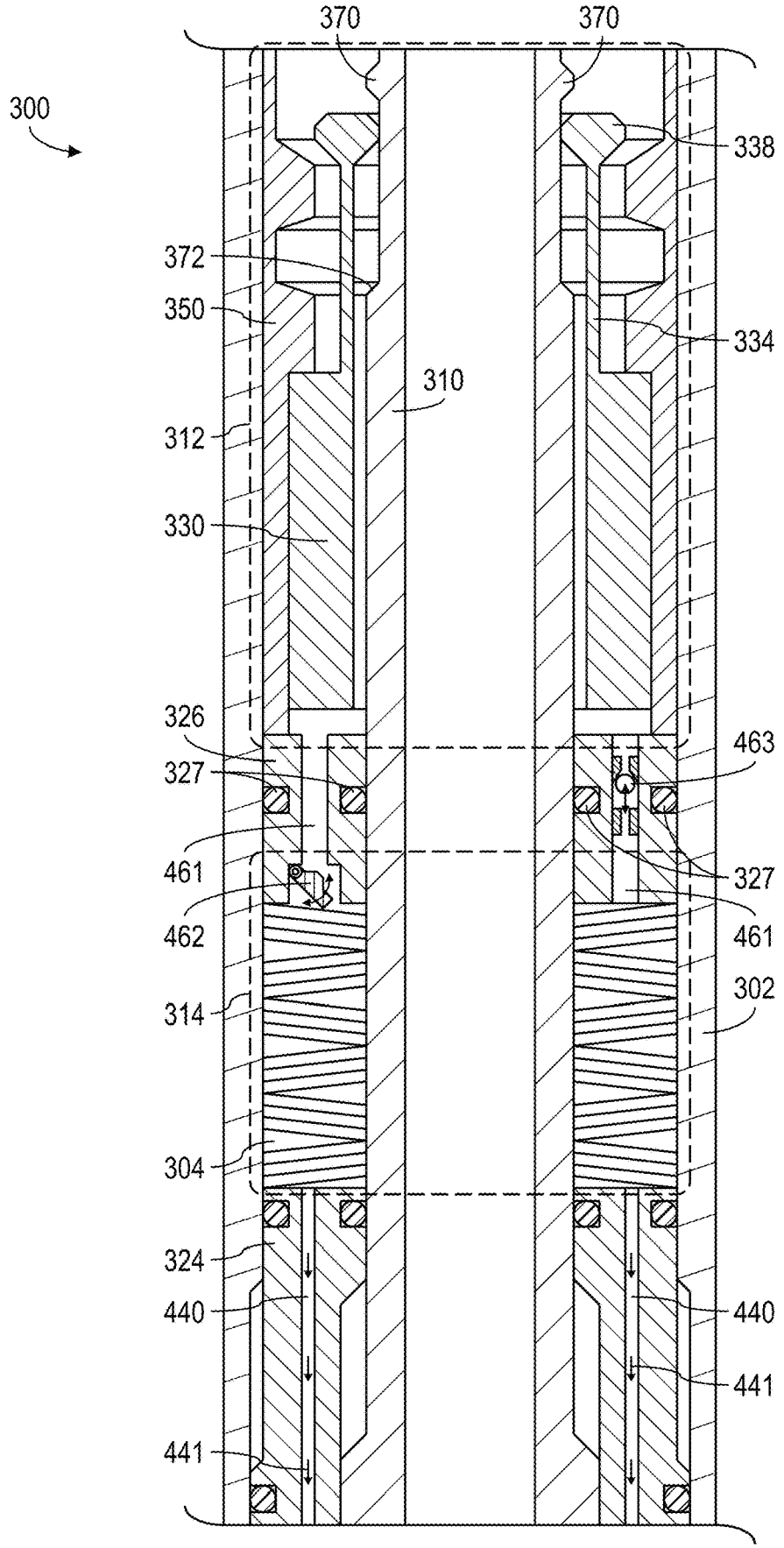
FIG. 5 is a schematic sectional view of a portion of an example implementation of the impact jar apparatus shown in FIGS. 2-4 according to one or more aspects of the present disclosure.

FIG. 5 is a schematic sectional view of a portion of an example implementation of the impact jar apparatus 200 shown in FIGS. 2-4, designated in FIG. 5 by reference number 300, according to one or more aspects introduced by the present disclosure. The impact jar apparatus 300 comprises a static portion (not referenced, but analogous to the static portion 250 shown in FIG. 3), which includes a tubular feature 310 that is an example implementation of the tubular feature 210 shown in FIGS. 2 and 3. The impact jar apparatus 300 also comprises a dynamic portion (not referenced, but analogous to the dynamic portion 251 shown in FIG. 4), which includes a latch 312, a biasing means 314, an adjuster 324, and a hydraulic piston 326 that, respectively, are example implementations of the latch 212, the biasing means 214, the adjuster 224, and the hydraulic piston 226 shown in FIGS. 2 and 4. The dynamic portion also includes an outer housing 302, such as may be directly or indirectly coupled with a connector for mechanically and electrically connecting the impact jar apparatus 300 to an upper tool string portion (e.g., the tool string portion 130 shown in FIG. 1). Although not depicted in FIG. 5, such connector may be similar or analogous to the connector 206 shown in FIG. 2.

The latch 312 includes an inner latch portion 330 and an outer latch portion 350. The outer latch portion 350 is threadedly and/or otherwise secured to the housing 302 and, thus, travels with the housing 302. The inner latch portion 330 is sandwiched between the outer latch portion 350 and the tubular feature 310 in a manner permitting axial movement of the inner latch portion 330 relative to the outer latch portion 350 and the tubular feature 310, as further described below. The biasing means 314 and the hydraulic piston 326, collectively, are axially retained between the outer latch portion 350 and the adjuster 324 within an annulus 304 defined between the housing 302 and the tubular feature 310. The adjuster 324 is threadedly engaged with the housing 302, such that rotation of the adjuster 324 moves the adjuster 324 axially relative to the housing 302, thereby further compressing or decompressing the biasing means 314 between the adjuster 324 and the hydraulic piston 326. Such rotation of the adjuster 324 therefore adjusts the static compression of the biasing means 314 to thereby adjust the trigger tension. The biasing means 314 is depicted as a Belleville washer stack, although one or more compression springs and/or other mechanical biasing members may alternatively (or additionally) be utilized.

Figure 6:
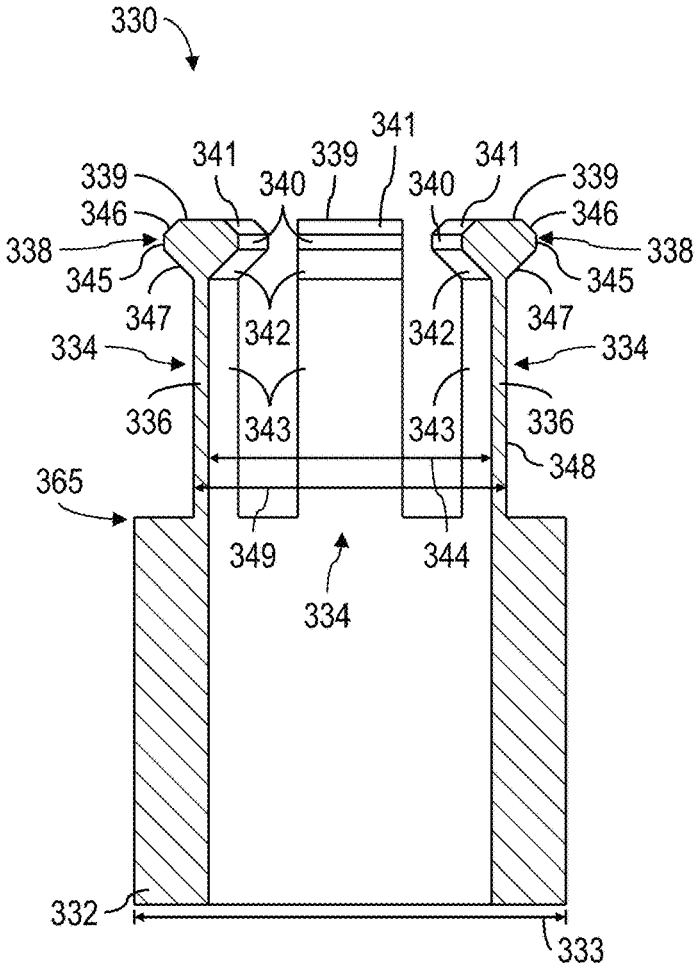
FIG. 6 is a schematic sectional view of an inner latch portion of the impact jar apparatus shown in FIG. 5 according to one or more aspects of the present disclosure.
Figure 7:
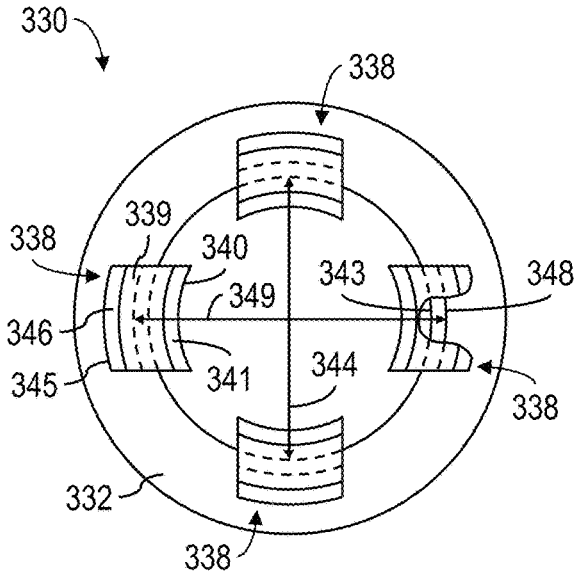
FIG. 7 is a schematic top view of the inner latch portion shown in FIG. 6 according to one or more aspects of the present disclosure.
Figure 8:
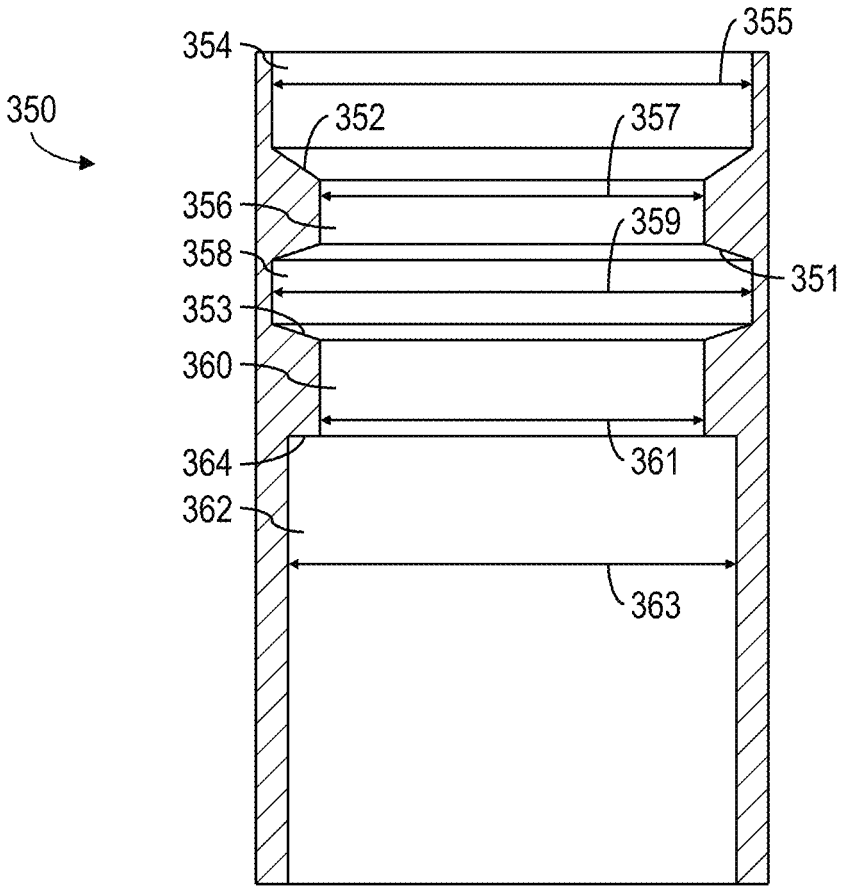
FIG. 8 is a schematic sectional view of an outer latch portion of the impact jar apparatus shown in FIG. 5 according to one or more aspects of the present disclosure.

FIGS. 6-8 each demonstrate one or more aspects introduced by the present disclosure. FIG. 6 is a schematic sectional view of the inner latch portion 330. FIG. 7 is a schematic top view of the inner latch portion 330. FIG. 8 is a schematic sectional view of the outer latch portion 350. The following description refers to FIGS. 6-8, collectively.

The inner latch portion 330 comprises an annular body 332 and a plurality of flexible collet fingers 334 extending upward from the body 332. Each flexible collet finger 334 has a thinned deflection segment 336 extending between the annular body 332 and a radially enlarged end 338. For example, in the depicted example implementation, each end 338 is defined by: a top surface 339; an inner curved surface 340; an optional upper inner tapered surface 341 transitioning between the top surface 339 and the inner curved surface 340; a lower inner tapered surface 342 transitioning between the inner curved surface 340 and a cylindrical surface 343 defined by an inner diameter 344 of the deflection segment 336; an outer curved surface 345; an upper outer tapered surface 346 transitioning between the top surface 339 and the outer curved surface 345; and a lower outer tapered surface 347 transitioning between the outer curved surface 345 and a cylindrical surface 348 defined by an outer diameter 349 of the deflection segment 336.

The upper inner tapered surface 341 is configured to interact with a correspondingly tapered protrusion (or some other ridge, shoulder, or protrusion) 370 extending outward from the tubular feature 310. The lower inner tapered surface 342 is configured to interact with a correspondingly tapered outer surface 372 of the tubular feature 310. The upper outer tapered surface 346 is configured to interact with a correspondingly tapered intermediate surface 351 of the outer latch portion 350. The lower outer tapered surface 347 is configured to interact with correspondingly tapered upper and lower surfaces 352, 353 of the outer latch portion 350.

The tapered upper surface 352 transitions between a cylindrical surface 354 defined by an upper larger inner diameter 355 and a cylindrical surface 356 defined by an upper smaller inner diameter 357. The tapered intermediate surface 351 transitions between the cylindrical surface 356 and a cylindrical surface 358 defined by an intermediate larger inner diameter 359. The tapered lower surface 353 transitions between the cylindrical surface 358 and a cylindrical surface 360 defined by a lower smaller inner diameter 361. The outer latch portion 350 also includes a cylindrical surface 362 defined by a lower intermediate inner diameter 363 corresponding to an outer diameter 333 of the inner latch portion annular body 332. The inner diameter 363 of the outer latch surface 362 is similar to but sufficiently larger than the outer diameter 333 of the inner latch body 332 so as to permit the outer latch portion 350 to slide axially along the inner latch portion 330. A shoulder 364 defined by the step change between the cylindrical surfaces 360, 362 provides a travel stop for an upper end 365 of the annular body 332 of the inner latch 330.

In the description above, the correspondingly tapered surfaces have the same or similar taper angles so as to encourage the relative motion described below with respect to the jarring operation. However, other relationships between the tapered surfaces intended to contact each other are also within the scope of the present disclosure.

The following description refers to FIGS. 1-8, collectively, in which the impact jar apparatus 150 of the tool string 105 is or comprises an instance of the impact jar apparatus 300, the tubular feature 310 is coupled (at least indirectly) to the lower tool string portion 140, and the lower tool string portion 140 has become stuck in the wellbore 110, thus necessitating a jarring operation utilizing the impact jar apparatus 300. During the jarring operation, the axial position of the tubular feature 310 is initially stationary (static), relative to the wellbore 110, due to being coupled to the lower tool string portion 140 that is stuck in the wellbore 110. Tension applied via the conveyance means 160 urges the dynamic (non-stuck) portion of the impact jar apparatus 300 upward, relative to the wellbore 110, in conjunction with the upward movement of the upper tool string portion 130 and the conveyance means 160.

The axially upward movement of the dynamic portion of the impact jar apparatus 300 initially causes the adjuster 324, the biasing means 314, the hydraulic piston 326, and the inner and outer latch portions 330, 350 to move upward relative to the tubular feature 310 until the tapered surface 341 (or the surface 339 if the tapered surface 341 is non-extant) contacts the tubular feature protrusion 370. The protrusion 370 subsequently prevents further upward movement of the inner latch portion 330, such that further upward movement of the housing 302 causes the outer latch portion 350 to move upward relative to the inner latch portion 330, whereby the collet finger ends 338 become sandwiched between the tubular feature 310 and the cylindrical surface 356 of the outer latch portion 350. Further upward movement of the housing 302 moves the cylindrical surface 356 past the collet finger ends 338, thus permitting the collet finger ends 338 to expand radially into the recess (not referenced) of the outer latch portion 350 defined by the cylindrical surface 358 and the tapered surfaces 351, 353, thereby disengaging the inner latch portion 330 from the protrusion 370. Such disengagement permits rapid upward movement of the dynamic portion of the impact jar apparatus 300 (and the upper tool string portion 130) relative to the tubular feature 310, resulting a feature of the dynamic portion of the impact jar apparatus 300 (e.g., the impact surface 218 shown in FIGS. 2 and 4) applying an uphole-directed impact against a feature of the static portion of the impact jar apparatus 300 (e.g., the impact surface 222 shown in FIGS. 2 and 3).

Upon the initial contact between the collet finger ends 338 and the tubular feature protrusion 370 (i.e., prior to the above-described impact), subsequent upward movement of the adjuster 324, the biasing means 314, the hydraulic piston 326, and the outer latch portion 350 causes the hydraulic piston 326 to contact the bottom of the inner latch portion body 332. Such contact prevents further upward movement of the hydraulic piston 326, such that further upward movement of the adjuster 324 compresses the biasing means 314 between the adjuster 324 and the hydraulic piston 326. The tension applied by the tensioning device 170 must overcome the expansion force of the biasing means 314 by an amount sufficient for the cylindrical surface 356 to move upward past the collet finger ends 338.

Moreover, the rate at which the adjuster 324 is able to move upward and compress the biasing means 314 is dependent upon the flow of hydraulic fluid out of the annulus 304 containing the biasing means 314. That is, the hydraulic piston 326 is an annular feature having seals (e.g., O-rings) 327 against the inner surface of the housing 302 and the outer surface of the tubular feature 310 that prevent the passage of fluid from the annulus 304. Consequently, axial contraction of the annulus 304 forces fluid in the annulus 304 to flow (see arrows 441) through various passages 440 in the adjuster toward a hydraulic manifold 328.

The hydraulic piston 326 may carry one or more check valves preventing fluid flow from the annulus 304 through one or more passages 461 that connect the annulus 304 to an annulus 311 at least partially defined between an inner profile of the outer latch portion 350 and an outer profile of the tubular feature 310. For example, the one or more check valves may comprise one or more flapper check valves 462, ball check valves 463, and/or other types of check valves permitting quick reset of the impact jar apparatus 300 without drawing fluid back through the flow restrictors 412, 422 described below.

Figure 9:
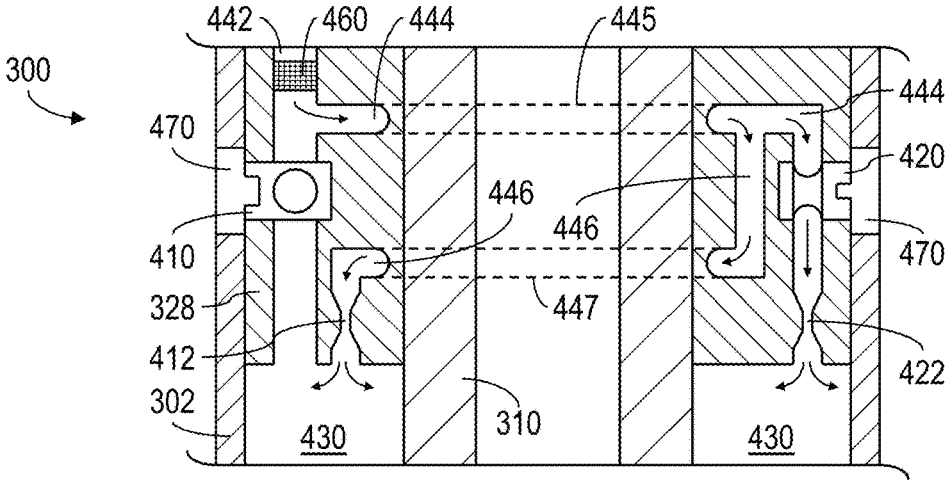
FIG. 9 is a schematic sectional view of a first configuration of a hydraulic manifold portion of the impact jar apparatus shown in FIG. 5 according to one or more aspects of the present disclosure.

FIG. 9 is a schematic sectional view of another portion of the impact jar apparatus 300, namely a portion of the hydraulic manifold 328. The hydraulic manifold 328 is an example implementation of the hydraulic manifold 228 shown in FIGS. 2 and 4 according to one or more aspects introduced by the present disclosure.

The hydraulic manifold 328 includes configurable means for optionally restricting the flow of fluid from the annulus 304. For example, the hydraulic manifold 328 includes first and second valves 410, 420 that are each set (at the wellsite surface) to an open or closed position to control fluid flow to first and second flow restrictors 412, 422. The first and second valves 410, 420 and the first and second flow restrictors 412, 422 control how quickly hydraulic fluid flows from the annulus 304 and into a fluid reservoir 430 and, thus, whether and how long activation of the impact jar apparatus 300 is delayed.

The first valve 410 receives fluid from a passage 442 that is in fluid communication with the fluid passages 440 of the adjuster 324. The second valve 420 is in fluid communication with a passage 444 (including a portion 445 that partially extends around the tubular feature 310 within the hydraulic manifold 328) that is in fluid communication with the passage 442. In the configuration depicted in FIG. 9, the first valve 410 is closed and the second valve 420 is open, such that fluid from the passage 444 flows through the second valve 420 to the second flow restrictor 422 and through additional passages 446 (including a passage 447 that partially extends around the tubular feature 310 within the hydraulic manifold 328) to the first flow restrictor 412. Accordingly, activation of the impact jar apparatus 300 is delayed by a first amount of time sufficient to permit enough hydraulic fluid to pass through the first and second flow restrictors 412, 422 and thereby permit the outer latch portion 350 to move upward by an amount sufficient to permit the inner latch portion 330 to disengage the tubular feature 310.

Figure 10:
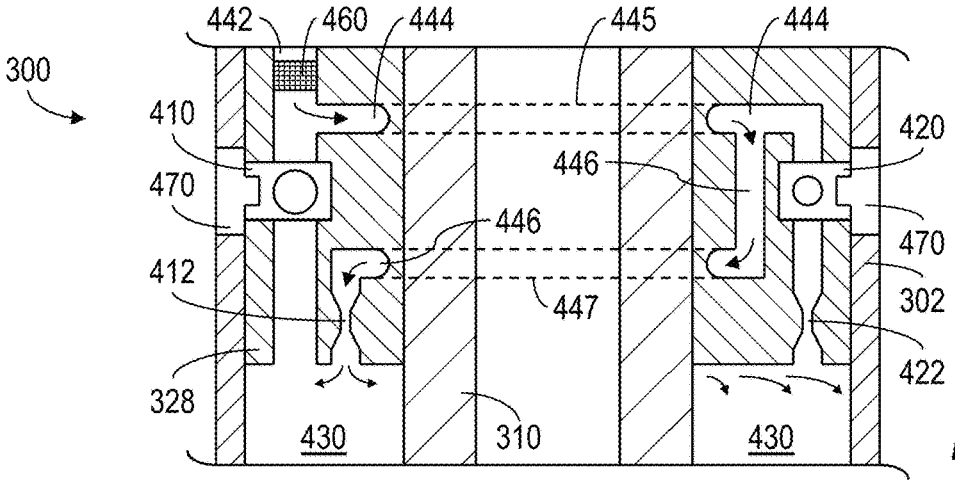
FIG. 10 is a schematic sectional view of a second configuration of the hydraulic manifold portion shown in FIG. 9 according to one or more aspects of the present disclosure.

However, when the first and second valves 410, 420 are both closed, as depicted in FIG. 10, fluid flows through just the first flow restrictor 412. Accordingly, activation of the impact jar apparatus 300 is delayed by a second amount of time, greater than the first amount of time (e.g., twice as long), sufficient to permit enough hydraulic fluid to pass through just the first flow restrictor 412 and thereby permit the outer latch portion 350 to move upward enough to permit disengagement of the inner latch portion 330 from the tubular feature 310.

Figure 11:
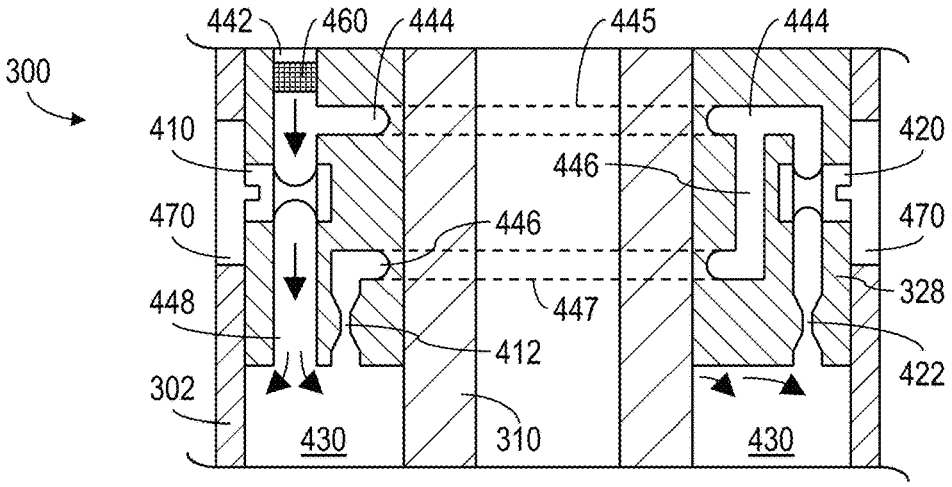
FIG. 11 is a schematic sectional view of a third configuration of the hydraulic manifold portion shown in FIGS. 9 and 10 according to one or more aspects of the present disclosure.

In the configuration depicted in FIG. 11, the first valve 410 is open, such that fluid from the passage 444 flows through just the first valve 410 to a passage 448, thus bypassing the first and second flow restrictors 412, 422. That is, the flow rate possible through the first valve 410 and the passage 448 is substantially greater (e.g., by an order of magnitude) than the combined flow rate possible through the first and second flow restrictors 412, 422, such that 90% or more of fluid received by the passage 444 flows through the first valve 410. Accordingly, activation of the impact jar apparatus 300 is delayed by a third amount of time sufficient to permit enough hydraulic fluid to pass through various passages 440, 442, 448 and the first valve 410 and thereby permit enough relative upward movement of the outer latch portion 350 to permit disengagement of the inner latch portion 330 from the tubular feature 310. The third amount of time may be minimal, such as less than 20% (e.g., perhaps less than 5%) of the first amount of time.

Referring also to FIG. 1, if the impact jar apparatus 150 includes activation delay means (such as the delay means described above and/or other delay means), the impact jar apparatus 150 may be triggered at almost any value above the predetermined activation tension. This permits the operator to start a jarring operation with an initial activation of the impact jar apparatus 150 that results in a low impact force and then, as needed, causing subsequent activations that may gradually increase the impact force. For example, the impact force of an initial activation may be about 5,000 pounds (lbs) and subsequent activations may increase the impact force in increments of about 250 lbs. Such approach of gradually increasing an initially low impact force may avoid damaging the impact jar apparatus 150, other components 130, 140 of the tool string 105, the conveyance means 160, the tensioning device 170, and/or other surface equipment 175.

Moreover, if the impact jar apparatus 150 does not include activation delay means (such as the delay means described above and/or other delay means), the impact jar apparatus 150 may be susceptible to inadvertent activation when, for example, tension applied to the tool string 105 unintentionally exceeds the trigger tension. Such occurrence is often not detectable quickly enough to reduce the tension via operation of the tensioning device 170 (e.g., due to angular momentum of a spool and/or other rotating feature(s) of the tensioning device 170 and/or linear momentum of the conveyance means 160 and upper tool string portion 130), such that the impact jar apparatus 150 is inadvertently activated. Such inadvertent activation can increase the time and cost of downhole operations. Moreover, each individual activation of the impact jar apparatus 150 can potentially damage other components 130, 140 of the tool string 105, the conveyance means 160, the tensioning device 170, other surface equipment 175, and potentially even the impact jar apparatus 150, which further increases operational and maintenance costs. However, by configuring the impact jar apparatus 150 to include a delay between the attainment of the trigger tension and activation (i.e., jarring), such as by utilizing the implementation of the impact jar apparatus 300 depicted in FIGS. 5-11, inadvertent tension spikes can be identified and rectified prior to such inadvertent jarring.

Thus, by introducing an activation delay according to one or more aspects introduced in the present disclosure, such as by utilizing the example configurations depicted in FIGS. 9 and 10, operational and maintenance time and costs can be reduced. The activation delay, for example, may be 30-60 seconds for the configuration depicted in FIG. 9 or 60-120 seconds for the configuration depicted in FIG. 10.

However, an activation delay may not be critical in some operations, such as when the predetermined trigger tension exceeds (e.g., by 25% and/or some other predetermined safety factor) a maximum conceivable tension to be applied to the tool string 105 during operations. In such scenarios, the impact jar apparatus 150 may be an instance of the impact jar apparatus 300 configured as depicted in FIG. 11, such that activation of the impact jar apparatus 300 occurs within a few seconds (e.g., less than 10 seconds) after the trigger tension is attained via operation of the tensioning device 170.

Although the flow restrictors 412, 422 are schematically depicted in FIGS. 9-11 as being integral to the hydraulic manifold 328, the flow restrictors 412, 422 may be discrete devices assembled with the hydraulic manifold 328. For example, the flow restrictors 412, 422 may be interchangeable with other, differently sized flow restrictors, so as to adjust the length of the activation delay. This permits adjustment of the activation delay without disassembly of the tool string 110. Accordingly, the length of the activation delay can even be adjusted at the wellsite by including job-specific flow restrictors 412, 422 and setting the open/closed positions of the valves 410, 420. Moreover, a malfunctioning flow restrictor 412, 422 can be replaced without disassembly of the tool string 110 (perhaps even at the wellsite), or at least without significant disassembly of the impact jar apparatus 300. Additionally, implementations within the scope of the present disclosure may also include more than the two flow restrictors 412, 422, such as to provide additional lengths of activation delays.

In FIGS. 9-11, arrow sizes and directions generally indicate fluid flow rates and directions, including fluid discharged from the flow restrictors 412, 422 and the passage 448 into the fluid reservoir 430. In some implementations, fluid entering the passage 442 may first flow through a filter 460 so that fluid entering the flow restrictors 412, 422 is free of particulate that could otherwise clog the flow restrictors 412, 422.

As also depicted in FIGS. 9-11, the housing 302 may include slots or other openings 470 by which the first and second valves 410, 420 may be accessed at the wellsite, so that the valves 410, 420 may be opened or closed to adjust the above-described activation delay. Although not depicted in FIGS. 9-11, the impact jar apparatus 300 may also comprise one or more covers that may be temporarily moved or removed to access the valves 410, 420 at the wellsite and then returned to a position that protects the valves 410, 420 from the downhole environment.

Figure 12:
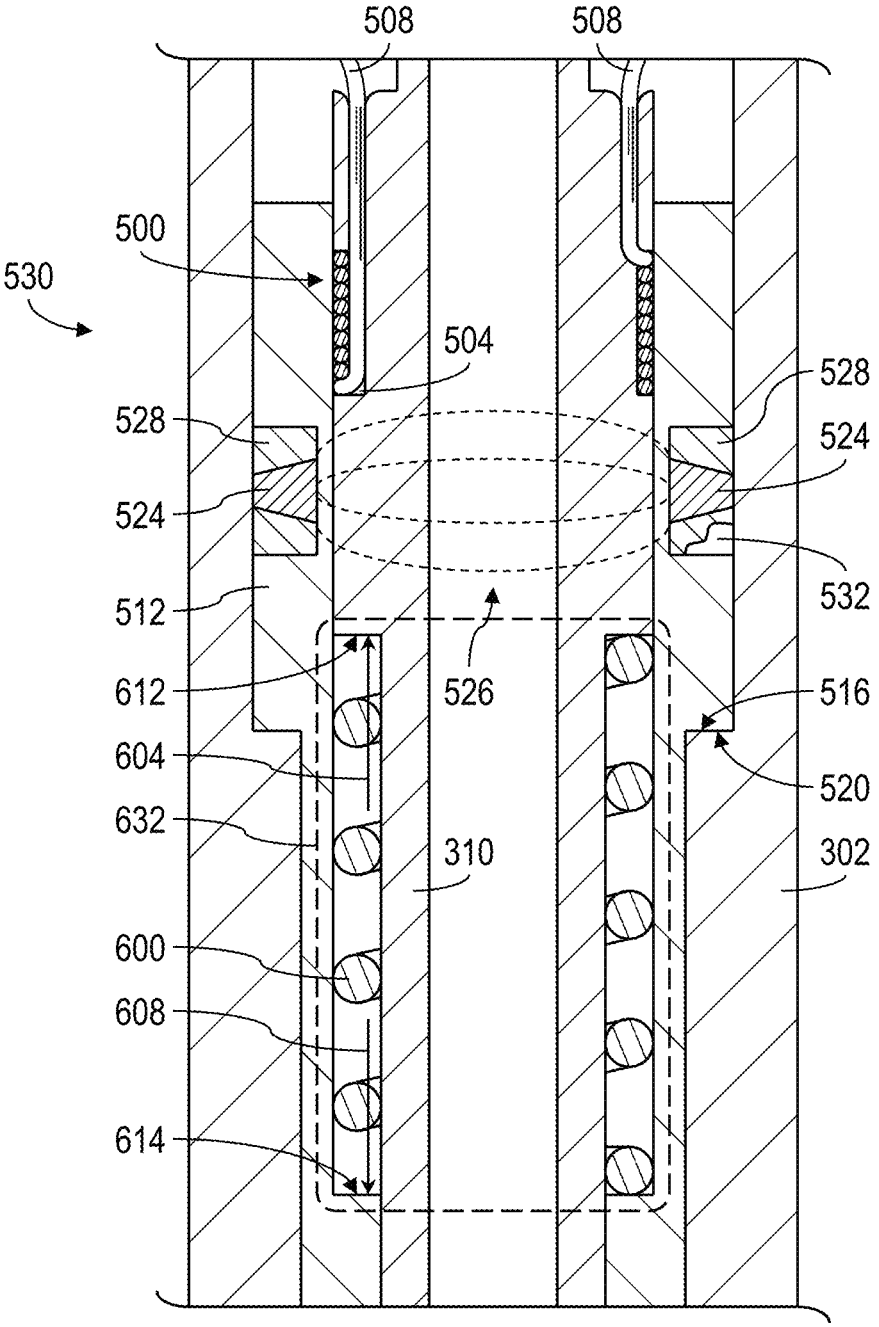
FIG. 12 is a schematic sectional view of activation indicator and relatch assist portions of the impact jar apparatus shown in FIG. 5 according to one or more aspects of the present disclosure.

FIG. 12 is a schematic sectional view of another portion of the impact jar apparatus 300 comprising an activation indicator 530 that is an example implementation of the activation indicator 230 shown in FIGS. 2 and 4, according to one or more aspects of the present disclosure. The example activation indicator 530 includes a wire coil 500 disposed within an exterior groove and/or other recess 504 of the tubular feature 310. Electrical connections 508 connect the wire coil 500 to a wire harness (not shown) of the impact jar apparatus 300. An internal chassis or other member 512 is threadedly and/or otherwise fixed relative to the outer housing 302. The axial positioning of the chassis 512 relative to the housing 302 may be set by contact between an internal, uphole-facing shoulder 516 of the housing 302 and an external, downhole-facing shoulder 520 of the chassis 512.

The chassis 512 includes a plurality of embedded magnets 524 extending circumferentially around the tubular feature 310, thus creating a predetermined magnetic field 526 depicted in FIG. 12 by dashed magnetic field lines. When the impact jar apparatus 300 activates, such that the housing 302 and the chassis 502 attached thereto collectively move upward relative to the tubular feature 310, the movement of the wire coil 500 through the magnetic field 526 generates a voltage pulse in the wire coil 500. This signal may be sent directly to the surface and read via a user interface (e.g., voltage panel) of a casing collar locator (CCL) and/or other surface equipment 175. Alternatively, or additionally, the signal from the wire coil 500 may be digitized in a telemetry cartridge (e.g., of the tool string module 130 depicted in FIG. 1) and sent to the surface equipment 175 via telemetry. Additional means for transmitting to the surface equipment 175 data based on the voltage pulse and/or other signal generated by the wire coil 500 are also within the scope of the present disclosure.

Surface availability of the signal from the wire coil 500 (or data based thereon) permits real-time confirmation that the impact jar apparatus 300 has activated. Such real-time confirmation that the impact jar apparatus 300 has activated can be vital during operations to dislodge a stuck portion of the tool string, especially if the impact jar apparatus 300 is configured for activating after the elapse of the above-described delay.

For example, with additional reference to FIG. 1, if the impact jar apparatus 150 is not configured to include the above-described delay, it is reasonable to assume that the impact jar apparatus 150 will activate within a few seconds (e.g., less than 2-3 seconds) after the trigger tension is applied to the tool string 105 via the conveyance means 160. However, by configuring the impact jar apparatus 150 to include a delay between attainment of the trigger tension and activation (i.e., jarring), such as in the implementation of the impact jar apparatus 300 depicted in FIGS. 5-11, inadvertent tension spikes can be identified and rectified prior to inadvertent jarring, and the signal generated by the wire coil 500 can be utilized to confirm that the impact jar apparatus 300 has been activated. Moreover, when the impact jar apparatus 300 relatches (as described below), the wire coil 500 again passes through the magnetic field 526, thus creating another voltage pulse indicative of relatch.

The speed at which the magnetic field 526 passes by the wire coil 500 is proportional to the voltage in the pulse. Such speed information may be utilized to estimate the actual jarring force generated by activation of the impact jar apparatus 300. Moreover, because the activation indicator 530 is a passive device, it may be implemented without the provision of additional power and associated electronics. It is also noted that other types of motion sensors, such as a Hall effect sensor or linear potentiometer, may also or instead be used to detect activation and/or relatch.

The magnets 524 may be comprised of samarium cobalt, neodymium, and/or other permanently magnetic materials. One or more retainers 528 may be utilized to retain the magnets 524 embedded within the chassis 512. In the example implementation depicted in FIG. 12, the retainers 528 are opposing portions of a clam-shell design that close around/within an external groove 532 of the chassis 512. However, other implementations are also within the scope of the present disclosure. For example, the external groove 532 may instead be a plurality of external recesses azimuthally spaced around the chassis 512, and each retainer 528 may be one of a plurality of discrete members each threadedly and/or otherwise retained within a corresponding one of the external recesses, thereby retaining a corresponding one of the magnets 524 within the chassis 512.

The following description refers to FIGS. 1, 2, and 12, collectively. Friction between the upper tool string portion 140 and the sidewall of the wellbore 110 (especially when the casing 180 is not extant) may restrict the ability of the impact jar apparatus 300 to relatch under the weight of the dynamic (unstuck) portion, the upper tool string portion 140, and the conveyance means 160, especially in non-vertical sections of the wellbore 110. Thus, as depicted in FIG. 12, the impact jar apparatus 300 may include a relatch assist 632, which is an example implementation of the relatch assist 232 shown in FIG. 2.

For example, the relatch assist 632 may comprise one or more compression springs (and/or other biasing members) 600 that, when compressed, generate an uphole-directed biasing force 604 and an opposing downhole-directed biasing force 608. In the example implementation depicted in FIG. 12, the uphole-directed biasing force 604 is applied against a downhole-facing shoulder and/or other feature 612 of the tubular feature 310 and the downhole-directed biasing force 608 is applied against an uphole-facing should and/or other feature 614 of the chassis 512. Thus, the biasing forces 604, 608 generated by the compression spring(s) 600 may be collectively operable to move the chassis 512 (and, thus, the housing 302) downward relative to the tubular feature 310 until returning to the latched position shown in FIG. 12.

That is, referring also to FIGS. 1 and 5, the tensioning device 170 is operated to reduce (or remove) the tension applied via the conveyance means 160 to the tool string 105. Consequently, the collective weight of the conveyance means 160, the upper tool string portion 130, and the dynamic portion of the impact jar apparatus 300, together with the biasing forces 604, 608, urge the dynamic portion of the impact jar apparatus 300 downward relative to the wellbore 110 and the tubular feature 310. Such movement brings the surface 342 downward into contact with the protrusion 370, which then deflects the collet finger ends 338 into the recess formed by the surfaces 351, 353, 358 such that the collet finger ends 338 can move downward past the protrusion 370. Further downward movement of the dynamic portion of the impact jar apparatus 300 brings the surface 342 downward into contact with the surface 372 such that the cylindrical surface 356 of the outer latch portion 350 move downward past the collet finger ends 338 until the inner and outer latch portions 330, 350 return to the latched configuration depicted in FIG. 5.

As described above, the combined weight of the conveyance means 160, the upper tool string portion 130, and the dynamic portion of the impact jar apparatus 300 may not be sufficient to overcome friction between such components and the wellbore 110 so as to successfully return the impact jar apparatus 300 to the latched configuration depicted in FIG. 5, especially in portions 112 of the wellbore 110 not having the casing 180. The additional biasing forces 604, 608 generated by the relatch assist 632 and urging the dynamic portion of the impact jar apparatus 300 downward relative to the tubular feature 310 may aid in overcoming such friction to successfully relatch the impact jar apparatus 300. While the example implementation of FIG. 12 depicts the relatch assist 632 comprising one or more compressions springs and/or other biasing means 600 between the chassis 512 and the tubular feature 310, the relatch assist 632 in other implementations within the scope of the present disclosure may be located in other and/or additional locations within the impact jar apparatus 300, and may comprise biasing means other than or in addition to the compression spring(s) 600 depicted in FIG. 12.

Figure 13:
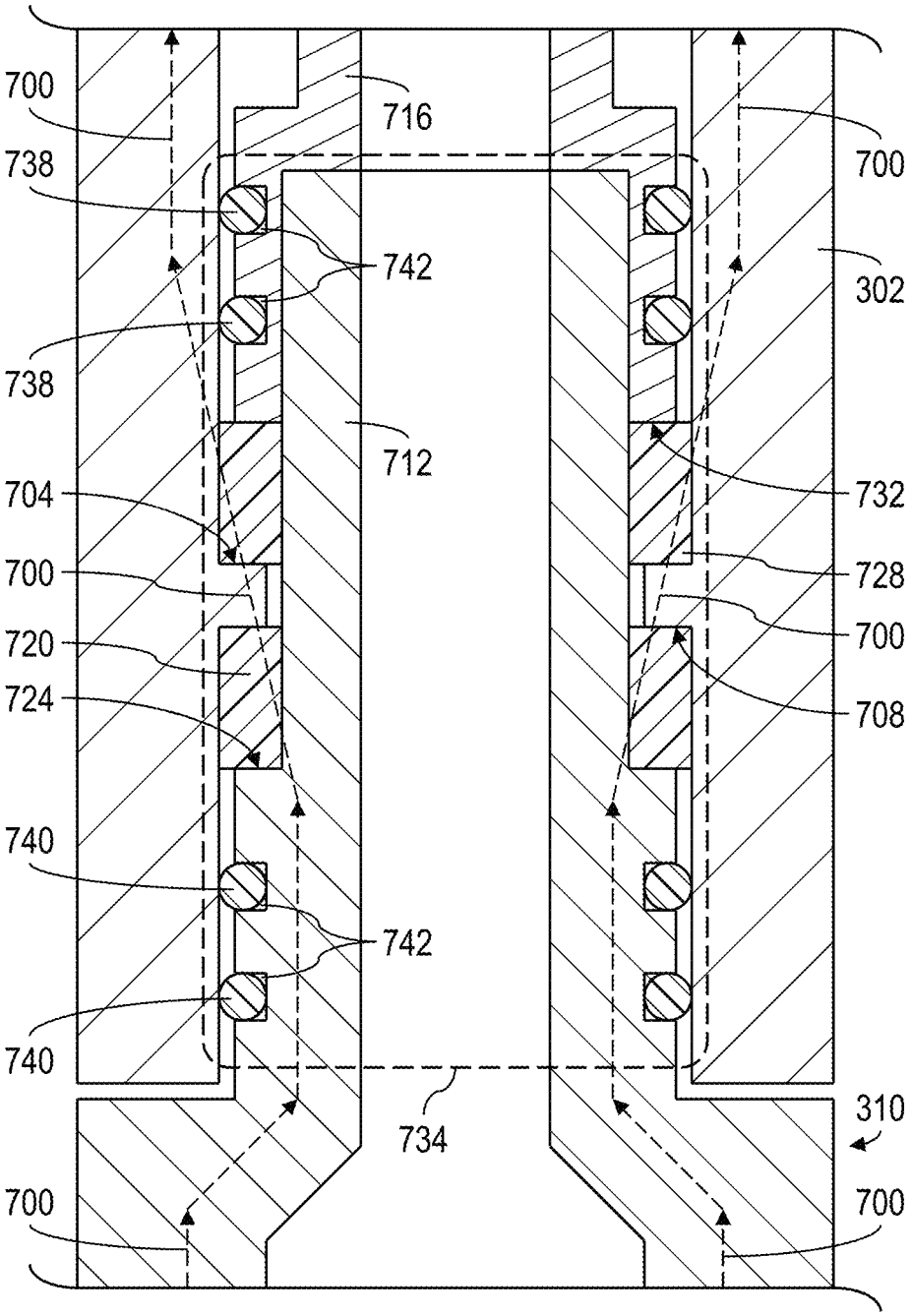
FIG. 13 is a schematic sectional view of a shock absorber portion of the impact jar apparatus shown in FIG. 5 according to one or more aspects of the present disclosure.

FIG. 13 is a schematic sectional view of another portion of the impact jar apparatus 300, including at least a portion of a shock absorber 734 that is an example implementation of the shock absorber 234 shown in FIGS. 2 and 4, according to one or more aspects introduced by the present disclosure. The following description refers to FIGS. 1, 2, 4, and 13, collectively, in which the impact jar apparatus 150 of FIG. 1 may be an instance of the impact jar apparatus 200 shown in FIGS. 2 and 4 which, in turn, may be an instance of the above-described impact jar apparatus 300.

The shock absorber 734 may reduce the force placed on sensitive components of the upper tool string portion 130 located above the impact jar apparatus 300, such as a cable head, telemetry cartridge, gamma ray module, and the like. The shock absorber 334 may comprise a plurality of elastomeric (e.g., VITON) bumper rings that absorb axial shock generated by activation of the impact jar apparatus 300, such that the axial shock is not transmitted (or is at least dampened) along mechanical load paths 700 to the upper tool string portion 130.

For example, the housing 302 may have an internal flange and/or other feature having an upward facing shoulder 704 and a downward facing shoulder 708, and the tubular feature 310 may comprise a first member 712 and a second member 716 that threadedly or otherwise fixedly receives an upper end of the first member 712. A first elastomeric bumper ring 720 may interposingly contact and thereby absorb axial shock between the downward facing shoulder 708 of the housing 302 and an upward facing shoulder 724 of the first tubular feature member 716. A second elastomeric bumper ring 728 may interposingly contact and thereby absorb axial shock between a bottom surface 732 of the second member 720 and the upward facing shoulder 704 of the housing 302. As depicted in FIG. 13, the first and second elastomeric bumper rings 720, 728 may be sized and positioned such that the mechanical load paths 700 between the dynamic and static portions of the impact jar apparatus 300 pass through the bumper rings 720, 728. Accordingly, the bumper rings 720, 728 may aid in reducing or preventing axial shock from being transmitted to the upper tool string portion 130 during activation of the impact jar apparatus 300.

The shock absorber 734 may also comprise a plurality of elastomeric (e.g., VITON) O-rings 738, 740 that aid in preventing hydraulic fluid from leaking out of the impact jar apparatus 300, and also provide stiffening when the impact jar apparatus 300 is subjected to bending forces. For example, as depicted in FIG. 13, the O-rings 738, 740 may be carried in external recesses 742 of the second tubular feature member 716 at multiple axial locations, perhaps including at least two O-rings 738 positioned axially above the bumper rings 720, 728 and at least two O-rings 740 positioned axially below the bumper rings 720, 728. The O-rings 738, 740 may also aid in preventing metal-to-metal contact and/or reduce shock transmission between the dynamic and static portions of the impact jar apparatus 300.

In view of the entirety of the present disclosure, including the figures and the claims, a person having ordinary skill in the art will readily recognize that the present disclosure introduces an impact jar apparatus comprising: a dynamic portion having a first connector for connection to an upper portion of a downhole tool string for conveyance within a wellbore penetrating a subterranean formation; a static portion having a second connector for connection to a lower portion of the tool string; and a hydraulic manifold in fluid communication with an annulus defined between the dynamic and static portions, wherein the hydraulic manifold is configurable to adjust a delay between application of a trigger tension to the tool string and consequent activation of the impact jar apparatus.

The hydraulic manifold may comprise: a first flow restrictor; a second flow restrictor; and first and second valves configurable to collectively control fluid flow from the annulus to the first and second flow restrictors and thereby adjust the delay. The first and second valves may be configurable to select the delay from one of a plurality of delays comprising: a first delay resulting from the first valve being closed and the second valve being open such that fluid from the annulus flows to the first and second flow restrictors; and a second delay resulting from the first and second valves being closed such that fluid from the annulus flows to the first flow restrictor and not the second flow restrictor. The second delay may be longer than the first delay. The second delay may be at least twice as long as the first delay. The plurality of delays may further comprise a third delay resulting from the first valve being open such that fluid from the annulus substantially bypasses the first and second flow restrictors. The plurality of delays may consist of just the first, second, and third delays.

The first and second flow restrictors may be interchangeable with other, differently sized flow restrictors so as to adjust the length of the activation delay.

The first and second valves may be configurable without disassembling the impact jar apparatus from the tool string.

The impact jar apparatus may comprise an activation indicator providing real-time confirmation, at a wellsite surface whence the wellbore extends, that the impact jar apparatus has activated.

The impact jar apparatus may comprise a relatch assist urging the dynamic and static portions toward a latched position.

The impact jar apparatus may comprise a shock absorber configured to absorb axial shock generated by activation of the impact jar apparatus.

The present disclosure also introduces an impact jar apparatus comprising: a dynamic portion having a first connector for connection to an upper portion of a downhole tool string for conveyance within a wellbore penetrating a subterranean formation; a static portion having a second connector for connection to a lower portion of the tool string; and an activation indicator providing real-time surface confirmation that the impact jar apparatus has activated. The activation indicator comprises: a wire coil disposed within an external recess of the static portion; and a plurality of magnets carried by the dynamic portion and generating a magnetic field such that a voltage pulse is generated in the wire coil in response to the magnetic field passing by the wire coil upon activation of the impact jar apparatus.

The activation indicator may provide real-time information indicative of a speed at which the magnetic field passes by the wire coil.

The activation indicator may provide real-time surface confirmation that the impact jar apparatus has relatched after activation.

The impact jar apparatus may comprise a hydraulic manifold in fluid communication with an annulus defined between the dynamic and static portions, wherein the hydraulic manifold is configurable to adjust a delay between application of a trigger tension to the tool string and consequent activation of the impact jar apparatus.

The impact jar apparatus may comprise a relatch assist urging the dynamic and static portions toward a latched position.

The impact jar apparatus may comprise a shock absorber configured to absorb axial shock generated by activation of the impact jar apparatus.

The present disclosure also introduces an impact jar apparatus comprising: a dynamic portion having a first connector for connection to an upper portion of a downhole tool string for conveyance within a wellbore penetrating a subterranean formation; a static portion having a second connector for connection to a lower portion of the tool string; and a relatch assist urging the dynamic and static portions toward a latched position.

The relatch assist may comprise a biasing member applying: an uphole-directed biasing force against the static portion; and a downhole-directed biasing force against the dynamic portion. The biasing member may be a compression spring applying: the uphole-directed biasing force against a downhole-facing shoulder of the static portion; and the downhole-directed biasing force against an uphole-facing shoulder of the dynamic portion.

The impact jar apparatus may comprise a hydraulic manifold in fluid communication with an annulus defined between the dynamic and static portions, wherein the hydraulic manifold is configurable to adjust a delay between application of a trigger tension to the tool string and consequent activation of the impact jar apparatus.

The impact jar apparatus may comprise an activation indicator providing real-time confirmation, at a wellsite surface whence the wellbore extends, that the impact jar apparatus has activated.

The impact jar apparatus may comprise a shock absorber configured to absorb axial shock generated by activation of the impact jar apparatus.

The present disclosure also introduces an impact jar apparatus comprising: a dynamic portion having a first connector for connection to an upper portion of a downhole tool string for conveyance within a wellbore penetrating a subterranean formation; a static portion having a second connector for connection to a lower portion of the tool string; and a shock absorber configured to absorb axial shock generated by activation of the impact jar apparatus.

The shock absorber may comprise a plurality of elastomeric bumper rings.

A housing of the dynamic portion may comprise an internal flange having a first upward facing shoulder and a downward facing shoulder; the static portion may comprise a first member and a second member that fixedly receives an upper end of the first member, wherein the first static portion member comprises a second upward facing shoulder and the second static portion member comprises a bottom surface; and the shock absorber may comprise first and second elastomeric bumper rings, the first elastomeric ring interposingly contacting the downward facing shoulder of the housing and second upward facing shoulder of the first static portion member, and the second elastomeric bumper ring interposingly contacting the bottom surface of the second static portion member and the first upward facing shoulder of the housing.

The impact jar apparatus may comprise a hydraulic manifold in fluid communication with an annulus defined between the dynamic and static portions, wherein the hydraulic manifold is configurable to adjust a delay between application of a trigger tension to the tool string and consequent activation of the impact jar apparatus.

The impact jar apparatus may comprise an activation indicator providing real-time confirmation, at a wellsite surface whence the wellbore extends, that the impact jar apparatus has activated.

The impact jar apparatus may comprise a relatch assist urging the dynamic and static portions toward a latched position.

The foregoing outlines features of several embodiments so that a person having ordinary skill in the art may better understand the aspects of the present disclosure. A person having ordinary skill in the art will appreciate that they may readily use the present disclosure as a basis for designing or modifying other processes and structures for carrying out the same functions and/or achieving the same benefits of the embodiments introduced herein. A person having ordinary skill in the art will also realize that such equivalent constructions do not depart from the scope of the present disclosure, and that they may make various changes, substitutions and alterations herein without departing from the scope of the present disclosure.

The Abstract at the end of this disclosure is provided to comply with 37 C.F.R. § 1.72 (b) to permit the reader to quickly ascertain the nature of the technical disclosure. It is submitted with the understanding that it will not be used to interpret or limit the scope or meaning of the claims.

What is claimed is:

1. An impact jar apparatus, comprising:

a dynamic portion having a first connector for connection to an upper portion of a downhole tool string for conveyance within a wellbore penetrating a subterranean formation;

a static portion having a second connector for connection to a lower portion of the tool string; and a hydraulic manifold in fluid communication with an annulus defined between the dynamic and static portions, wherein the hydraulic manifold is configurable to adjust a delay between application of a trigger tension to the tool string and consequent activation of the impact jar apparatus;

wherein the hydraulic manifold comprises:

a first flow restrictor;

a second flow restrictor; and first and second valves configurable to collectively control fluid flow from the annulus to the first and second flow restrictors and thereby adjust the delay; and wherein the first and second valves are configurable to select the delay from one of a plurality of delays comprising:

a first delay resulting from the first valve being closed and the second valve being open such that fluid from the annulus flows to the first and second flow restrictors; and a second delay resulting from the first and second valves being closed such that fluid from the annulus flows to the first flow restrictor and not the second flow restrictor.

2. The impact jar apparatus of claim 1 wherein the second delay is longer than the first delay.

3. The impact jar apparatus of claim 1 wherein the second delay is at least twice as long as the first delay.

4. The impact jar apparatus of claim 1 wherein the plurality of delays further comprises a third delay resulting from the first valve being open such that fluid from the annulus substantially bypasses the first and second flow restrictors.

5. The impact jar apparatus of claim 1 wherein the first and second flow restrictors are interchangeable with other, differently sized flow restrictors so as to adjust the length of the activation delay.

6. The impact jar apparatus of claim 1 further comprising an activation indicator providing real-time confirmation, at a wellsite surface whence the wellbore extends, that the impact jar apparatus has activated.

7. The impact jar apparatus of claim 1 further comprising a relatch assist urging the dynamic and static portions toward a latched position.

8. The impact jar apparatus of claim 1 further comprising a shock absorber configured to absorb axial shock generated by activation of the impact jar apparatus.

9. An impact jar apparatus, comprising:

a dynamic portion having a first connector for connection to an upper portion of a downhole tool string for conveyance within a wellbore penetrating a subterranean formation;

a static portion having a second connector for connection to a lower portion of the tool string; and an activation indicator providing real-time surface confirmation that the impact jar apparatus has activated, wherein the activation indicator comprises:

a wire coil disposed within an external recess of the static portion; and a plurality of magnets carried by the dynamic portion and generating a magnetic field such that a voltage pulse is generated in the wire coil in response to the magnetic field passing by the wire coil upon activation of the impact jar apparatus.

10. The impact jar apparatus of claim 9 wherein the activation indicator also provides real-time surface confirmation that the impact jar apparatus has relatched after activation.

11. The impact jar apparatus of claim 9 further comprising a hydraulic manifold in fluid communication with an annulus defined between the dynamic and static portions, wherein the hydraulic manifold is configurable to adjust a delay between application of a trigger tension to the tool string and consequent activation of the impact jar apparatus.

12. The impact jar apparatus of claim 9 further comprising a relatch assist urging the dynamic and static portions toward a latched position.

13. The impact jar apparatus of claim 9 further comprising a shock absorber configured to absorb axial shock generated by activation of the impact jar apparatus.

14. An impact jar apparatus, comprising:

a dynamic portion having a first connector for connection to an upper portion of a downhole tool string for conveyance within a wellbore penetrating a subterranean formation;

a static portion having a second connector for connection to a lower portion of the tool string; and a shock absorber comprising a plurality of elastomeric bumper rings that are collective configured to absorb axial shock generated by activation of the impact jar apparatus.

15. The impact jar apparatus of claim 14 further comprising a relatch assist urging the dynamic and static portions toward a latched position, wherein the relatch assist comprises a biasing member applying:

an uphole-directed biasing force against the static portion; and a downhole-directed biasing force against the dynamic portion.

16. The impact jar apparatus of claim 14 further comprising a hydraulic manifold in fluid communication with an annulus defined between the dynamic and static portions, wherein the hydraulic manifold is configurable to adjust a delay between application of a trigger tension to the tool string and consequent activation of the impact jar apparatus.

17. The impact jar apparatus of claim 14 further comprising an activation indicator providing real-time confirmation, at a wellsite surface whence the wellbore extends, that the impact jar apparatus has activated.

18. The impact jar apparatus of claim 14 wherein:

a housing of the dynamic portion comprises an internal flange having a first upward facing shoulder and a downward facing shoulder;

the static portion comprises:

a first member; and a second member that fixedly receives an upper end of the first member;

the first static portion member comprises a second upward facing shoulder;

the second static portion member comprises a bottom surface;

the plurality of elastomeric bumper rings comprise first and second elastomeric bumper rings;

the first elastomeric ring interposingly contacts the downward facing shoulder of the housing and the second upward facing shoulder of the first static portion member; and the second elastomeric bumper ring interposingly contacts the bottom surface of the second static portion member and the first upward facing shoulder of the housing.

19. The impact jar apparatus of claim 14 further comprising:

a hydraulic manifold in fluid communication with an annulus defined between the dynamic and static portions, wherein:

the hydraulic manifold is configurable to adjust a delay between application of a trigger tension to the tool string and consequent activation of the impact jar apparatus;

the hydraulic manifold comprises:

a first flow restrictor;

a second flow restrictor; and first and second valves configurable to collectively control fluid flow from the annulus to the first and second flow restrictors and thereby adjust the delay;

an activation indicator providing real-time confirmation, at a wellsite surface whence the wellbore extends, that the impact jar apparatus has activated, wherein the activation indicator comprises:

a wire coil disposed within an external recess of the static portion; and a plurality of magnets carried by the dynamic portion and generating a magnetic field such that a voltage pulse is generated in the wire coil in response to the magnetic field passing by the wire coil upon activation of the impact jar apparatus; and a relatch assist urging the dynamic and static portions toward a latched position.

20. The impact jar apparatus of claim 19 wherein:

the first and second valves are configurable to select the delay from one of a plurality of delays comprising:

a first delay resulting from the first valve being closed and the second valve being open such that fluid from the annulus flows to the first and second flow restrictors;

a second delay resulting from the first and second valves being closed such that fluid from the annulus flows to the first flow restrictor and not the second flow restrictor, wherein the second delay is longer than the first delay; and a third delay resulting from the first valve being open such that fluid from the annulus substantially bypasses the first and second flow restrictors;

the activation indicator also provides real-time surface confirmation that the impact jar apparatus has relatched after activation;

the relatch assist comprises a biasing member applying:

an uphole-directed biasing force against the static portion; and a downhole-directed biasing force against the dynamic portion;

a housing of the dynamic portion comprises an internal flange having a first upward facing shoulder and a downward facing shoulder;

the static portion comprises:

a first member; and a second member that fixedly receives an upper end of the first member;

the first static portion member comprises a second upward facing shoulder;

the second static portion member comprises a bottom surface;

the plurality of elastomeric bumper rings comprise first and second elastomeric bumper rings;

the first elastomeric ring interposingly contacts the downward facing shoulder of the housing and the second upward facing shoulder of the first static portion member; and the second elastomeric bumper ring interposingly contacts the bottom surface of the second static portion member and the first upward facing shoulder of the housing.

* * * * *